United States Patent [19]

Crawford et al.

[11] 4,444,566

[45] Apr. 24, 1984

[54] STABILIZED MIDDLE DISTILLATE FUEL COMPOSITION

[75] Inventors: Wheeler C. Crawford, Houston, Tex.; William M. Sweeney, Wappingers Falls; Rodney L. Sung, Fishkill, both of N.Y.

[73] Assignee: Texaco Inc., White Plains, N.Y.

[21] Appl. No.: 432,505

[22] Filed: Oct. 4, 1982

[51] Int. Cl.[3] ..... C10L 1/22

[52] U.S. Cl. ..... 44/72; 252/403; 252/405

[58] Field of Search ..... 44/72; 252/403, 405; 564/505

[56] References Cited

U.S. PATENT DOCUMENTS

| | | | |
|---|---|---|---|
| 3,496,138 | 2/1970 | Sellers et al. | 564/505 |
| 3,787,354 | 1/1974 | Cyba | 44/72 |
| 4,181,682 | 1/1980 | Watts, Jr. | 564/505 |
| 4,332,595 | 6/1982 | Herbstman | 564/505 |

*Primary Examiner*—Charles F. Warren

*Assistant Examiner*—Y. Harris-Smith

*Attorney, Agent, or Firm*—Robert A. Kulason; Robert Knox, Jr.; Alan M. Kamel

[57] ABSTRACT

A fuel composition comprising a mixture of hydrocarbons boiling in the middle distillate boiling range and an effective stabilizing amount of a alpha, omega diamino poly(oxypropylene) poly(oxyethylene) poly(oxypropylene) represented by the formula:

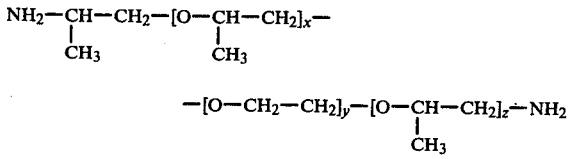

wherein x and z each has an approximate value ranging from 1 to 3 such that the sum of x plus z has an average value ranging from 3 to 4, and y has an approximate value ranging from 10 to 16.

10 Claims, No Drawings

STABILIZED MIDDLE DISTILLATE FUEL COMPOSITION

BACKGROUND OF THE INVENTION

1. Field of the Invention

Various types of petroleum-derived hydrocarbon oils undergo deterioration on storage, and particularly on exposure to air on standing for extended lengths of time. Thus fuel oils, such as diesel fuel, jet fuel, burner oil, and furnace oils undergo deterioration as evidenced by such changes as the formation of sediment. This deterioration depends in part on the composition of the blending stock which make up the fuel. In general the more cracked stocks used in making up the fuel blend, the greater the instability of the fuel. Similarly, fuel derived from star sands, shale oil, or by the H-Oil process generally have a higher naphthenic content and are less stable. Other factors contributing to instability would include the cleanliness of the fuel itself and the conditions of storage.

Sediment formation is undesirable for various reasons. The settling of the accumulated particles in tanks storing hydrocarbon oils requires periodic draining and cleaning of the storage tanks leading to temporary unavailability of storage capacity, substantial diversion of manpower, and waste disposal problems. Sediment formation in burner oil tends to plug strainers, burner tips, and injectors. In diesel fuel, such sediment tends to form sludge and varnish in the engine. If the oil is used as a heat exchange medium, as for example with jet fuel, the sediment tends to plug exchanger coils. It is apparent, therefore, that reduced sediment formation in hydrocarbon oils is very important.

One method of effecting sediment reduction would be to eliminate to a substantial degree, those processes leading to particulate formation, such as oxidation. Another method would be to prevent agglomeration and/or settling of the formed particulate matter by effectively maintaining the fine particles in a well dispersed state, so that the difficulties associated with the sediment formation either do not occur or are of substantially lessened severity.

It is the primary object of this invention to improve the stability of middle distillate fuels against the formation of precipitation of sediment.

2. Description of the Prior Art

U.S. Pat. No. 3,309,182 issued Mar. 14, 1967, discloses a polyether diamine as a stabilizer for petroleum distillate fuels.

U.S. Pat. No. 3,236,895 issued Feb. 22, 1966, discloses novel polyoxyalkylene polyamines and method of preparing these amines.

U.S. Pat. No. 3,654,370 issued Apr. 4, 1972, discloses a method for preparing polyoxyalkylene polyamines.

SUMMARY OF THE INVENTION

A stabilized middle distillate fuel composition has been discovered comprising a mixture of hydrocarbons boiling in the middle distillate boiling range, (300° to 700° F.) and a minor stabilizing amount of a alpha omega diamino poly(oxypropylene) poly(oxyethylene) poly(oxypropylene) having the following formula:

$$NH_2-\underset{\underset{CH_3}{|}}{CH}-CH_2-[O-\underset{\underset{CH_3}{|}}{CH}-CH_2]_x-$$

-continued $$-[O-CH_2-CH_2]_y-[O-\underset{\underset{CH_3}{|}}{CH}-CH_2]_z-NH_2$$

wherein x and z each has an approximate value ranging from 1 to 3 such that the sum of x plus z has an average value ranging from 3 to 4 and y has an approximate value ranging from 10 to 16 and, as a solubilizing agent for said diamino compound a mixture comprising a $C_1$ to $C_4$ alkanol and an alkylated benzene having at least one and possibly two alkyl substituents wherein the alkyl substituent has from 1 to 2 carbon atoms. Middle distillate fuel compositions containing substantial amounts of cracked hydrocarbon stocks or hydrocarbons derived from non-mineral oil sources are also improved by the prescribed solubilized stabilizers.

DETAILED DESCRIPTION OF THE INVENTION

This invention is particularly concerned with middle distillate fuels comprising hydrocarbons boiling in the range from about 300° F. to about 700° F., a minor stabilizing amount of an additive having the following formula:

$$NH_2-\underset{\underset{CH_3}{|}}{CH}-CH_2-[O-\underset{\underset{CH_3}{|}}{CH}-CH_2]_x-$$

$$-[O-CH_2-CH_2]_y-[O-\underset{\underset{CH_3}{|}}{CH}-CH_2]_z-NH_2$$

wherein x and z each has an approximate value ranging from 1 to 3 such that the sum of x plus z has an average value ranging from 3 to 4, and y has an approximate value from 10 to 16 and, as a solubilizing agent for said diamino, a mixture comprising a $C_1$ to $C_4$ alkanol and an alkylated benzene having at least one and possibly two alkyl substituents wherein the alkyl substituents has from 1 to 2 carbon atoms. Preferably x and z each has a value within the range from 1 to 3, such that the sum of x plus z has an average value ranging from 3 to 4. Preferably y has a value ranging from about 12 to 15, and most preferably y has a value of approximately 13 to 14.

The hydrocarbon fuels with which this invention is primarily concerned are petroleum distillates or any mixtures of these that can be employed in various burner systems, as fuels for diesel engines, as aviation turbine fuels, and as domestic or industrial heating oils. These fuels may be generally characterized as those are derived from straight run middle distillate fuels, thermal and catalytically cracked hydrocarbon fuels and mixtures of cracked fuels and straight run middle distillate fuels in the range of from about 300° F. to about 750° F., and particularly those boiling between 400° F. and 650° F. It is a common practice to incorporate cracked hydrocarbon stocks in such fuels, and this practice aggravates the tendency of the fuels to form sediment on storage. It has been found that if 10 percent or more of a fuel composition comprises cracked stocks, the formation of sludge or sediment during storage may markedly increase, leading to the plugging or fouling of oil lines, filters and burner nozzles.

Particularly improved middle distillate fuel compositions are those containing a substantial amount of a hydrocarbon stock within the prescribed boiling range but derived from non-mineral oil sources. Non-mineral oil stocks derived from shale oil, tar sands or those synthetically produced tend to impair the storage stability of middle distillate fuels into which they are blended with the result that such blended fuel composition have a need for an effective stabilizer.

The amount of non-mineral oil middle distillate fuel which may be employed to extend the conventional mineral oil fuel composition of this invention will range from about 1 to 30 weight percent of the fuel composition. The preferred amount of non-mineral oil extender based on the total weight of the extended middle distillate fuel composition ranges from about 5 to 15 weight percent with the most preferred amount ranging from about 5 to 10 weight percent.

Typical fuels for use in accordance with the present invention are those meeting the requirements for Diesel 1 and Diesel 2 fuel oils as set forth in ASTM Specification D-396-48T, diesel fuels falling within D-1, D-2 and D-4 grades of ASTM Specification D0975-51T and aviation fuels for gas turbines as covered by U.S. military Specification MIL-F-5624C.

The alpha omega diamino poly(oxypropylene) poly(oxyethylene) poly(oxypropylene) component of the inventive fuel is prepared by the addition of propylene oxide to a polyethylene glycol followed by amination. Such diamino polyalkylene compounds include those made and sold by the Texaco Chemical Company under the tradename Jeffamine ®Poly(oxyethylene) diamines (ED Series). These additives are represented by the following general formula:

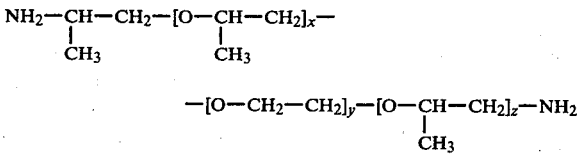

The particular Jeffamine ®poly(oxypropylene) poly(oxyethylene) poly(oxypropylene) diamines which are effective as stabilizers for middle distillate fuel oils have the following generic formula wherein x and z each has an approximate value ranging from 1 to 3 and the approximate value of the sum of x plus z ranges from 3 to 4, and y has an approximate value ranging from 10 to 16.

Specific examples of diamino poly(oxypropylene) poly(oxyethylene) poly(oxypropylenes) that may be utilized in this invention are: alpha, omega diamino, mono(oxypropylene) deca(oxyethylene) tri(oxypropylene); alpha, omega diamino mono(oxypropylene) undeca(oxyethylene) tri(oxypropylene); alpha, omega diamino mono(oxypropylene) dodeca(oxyethylene) tri(oxypropylene); alpha omega diamino tri(oxypropylene) deca(oxyethylene) mono(oxypropylene); alpha omega diamino tri(oxypropylene) deca(oxyethylene) mono(oxypropylene); alpha omega diamino tri(oxypropylene) dodeca(oxyethylene) mono(oxypropylene); alpha, omega diamino tri(oxypropylene) tetradeca(oxyethylene) mono(oxypropylene); and alpha omega diamino tri(oxypropylene) pentadeca(oxyethylene) mono(oxypropylene).

The solubilizing agent for the fuel stabilizer employed in this invention comprises a mixture of a $C_1$ to $C_4$ alkanol and an alkylated benzene having one to two alkyl groups having from 1 to 2 carbon atoms. The alkanols which are suitable include methanol, ethanol, n-propanol, isopropanol and the butanols. The alkylated benzene components which are suitable include toluene, xylene and ethylene. In general, the solubilizing agent consists of approximately equal weight amounts of the alkanol and of the alkylated benzene.

In accordance with the present invention, the sediment forming tendencies of middle distillate hydrocarbon fuels, and particularly heating oils, can be markedly reduced by incorporating an effective stabilizing amount, ordinarily a minor proportion of the order of about 0.0001 to 0.1 percent by weight of alpha, omega diamino poly(oxypropylene) poly(oxyethylene) poly(oxypropylenes) into the fuel composition. Preferably the sediment inhibiting additive comprises from about 0.005 to 0.05 weight percent of the middle distillate fuels of the invention and most preferably about 0.01 weight percent.

The solubilizing agent is employed in an amount effective for dissolving the diamino polyalkylene additive in the hydrocarbon fuel. In general, the solubilizing agent is employed at a concentration ranging from about 1 to 5 percent of the base fuel with the preferred concentration being from about 2 to 4 weight percent.

Specific examples of the preparation of the stabilizing middle distillate fuel of this invention are illustrated below:

EXAMPLE 1

0.0085 g of Texico Chemical Company's Jeffamine ED 600, a colorless liquid alpha, omega diamino poly(oxypropylene) poly(oxyethylene) poly(oxypropylene) having a structure corresponding to the formula:

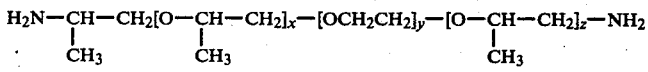

wherein x and z each has an approximate value ranging from 1 to 3 and the sum of x plus z has an average value of 3.5 and y has an average of 13.5 was added to 119 milliliters of a mineral oil processed by conventional refining methods and having the following characteristics:

| | |
|---|---|
| Gravity, API | 35.2 |
| Kinetic Viscosity, 100° F., cs | 2.86 |
| Flash Point, °F. | 162 |
| Pour Point, °F. | +5 |
| Cloud Point, °F. | +4 |
| ASTM distillation: | |
| Initial boiling point | 400° F. |
| 10% distilled at | 426° F. |
| 30% distilled at | 479° F. |
| 50% distilled at | 517° F. |
| 70% distilled at | 554° F. |
| 90% distilled at | 597° F. |
| 95% distilled at | 615° F. |
| Final Boiling Point | 628° F. |

The dissolution of the alpha omega diamino poly(oxypropylene) poly(oxyethylene) poly(oxypropylene) in the mineral oil was aided by the addition of 1 milliliter of ethanol and 1 milliliter of xylene to the oil-diamino polyoxyalkylene mixture.

COMPARATIVE EXAMPLE 2

The same procedure as described in Example 1 was followed, except that the alpha omega diamino poly(oxypropylene) poly(oxyethylene) poly(oxypropylene) employed was Texaco Chemical Company's Jeffamine ED 900 which has the formula:

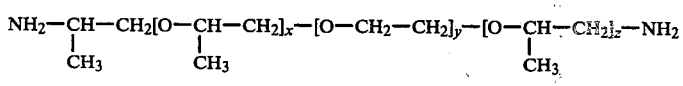

wherein x and z each has an approximate value ranging from 1 to 3 and the sum of x plus z has an average value of 3.5 and y has an average value of 20.5, and 1 milliliter of only ethanol was added to dissolve the diamino poly(oxyalkylene) stabilizer.

COMPARATIVE EXAMPLE 3

The same procedure as described in Example 1 was followed, except that the alpha, omega diamino poly(oxypropylene) poly(oxyethylene) poly(oxypropylene) employed was Texaco Chemical Company's Jeffamine ED 2001 which has the formula:

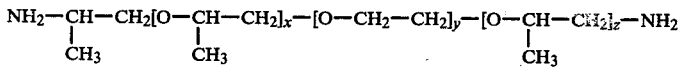

wherein x and z each has an approximate value ranging from 1 to 3, the sum of x plus z has an average value of 3.5 and y has an average value of 45.5. and 1 milliliter of only ethanol was added to dissolve the diamino poly(oxyalkylene).

The middle distillate fuel compositions of Examples 1 through 3 were tested for stability in the Potential Deposit Test. The Potential Deposit Test procedure requires filtering of 100 ml of the test fuel into a test tube through a 15 centimeter Number 1 Whatman filter paper. An air delivery tube was inserted in the test tube through a cork that has been slotted on the sides to allow the air to escape. The delivery tube was adjusted so that its tip which has been cut at a 45 degree angle, just touches the bottom of the test tube. The test tube was placed in an oil bath of 270±1° F. and preheated. The delivery tube was connected to a flow meter and air was bubbled through the fuel for 2 hours at a rate of 3 liters per hour. To remove acidic materials from the air, the air was first bubbled through 20% caustic solution, and then bubbled through distilled water prior to passing it through the test fuel. The test tube was removed from the oil bath, the oil was wiped from the outside of the tube and the tube was placed in a constant temperature bath maintained at 77±0.5° F. The test fuel sample was then filtered using suction at pressure of 75 to 85 mm Hg below atmospheric pressure through a 4.25 cm. No. 1 Whatman filter paper clamped between two halves of Millipore filter holder. The fuel oil from the funnel and filter paper was washed with three, 5 ml portions of n-heptene. The filter paper disk was removed and compared visually with those on the Potential Deposit Code.

The Base Fuel employed in the Potential Deposit Test was the same as the mineral oil employed in Examples 1 through 3, a mineral oil processed by conventional refining methods and having the following characteristics:

| | |
|---|---|
| Gravity, API | 35.2 |
| Kinetic Viscosity, 100° F., cs | 2.86 |
| Flash Point, °F. | 162 |
| Pour Point, °F. | +5 |
| Cloud Point, °F. | +4 |
| ASTM distillation: | |
| Initial boiling point | 400° F. |
| 10% distilled at | 426° F. |
| 30% distilled at | 479° F. |
| 50% distilled at | 517° F. |
| 70% distilled at | 554° F. |
| 90% distilled at | 597° F. |
| 95% distilled at | 615° F. |
| Final Boiling Point | 628° F. |

The results of the Potential Deposit Test are shown below in Table I.

TABLE I

The Potential Deposit Test

| Run | Fuel | Additive @ Concentration, wt. % | Test Rating(1) |
|---|---|---|---|
| 1 | Base Fuel + 2 wt. % Ethanol + 2 wt. % Xylene | No additive | 4+ |
| 2 | FUEL COMPOSITION OF EXAMPLE 1 | | |
| | Base Fuel + 2 wt. % Ethanol + 2 wt. % Xylene | 0.0095 wt % (25 PTB) of Jeffamine ® ED 900 | 2 |
| 3 | Base Fuel and 2 wt % Ethanol | No additive | 4+ |
| 4 | FUEL COMPOSITION OF EXAMPLE 2 | | |
| | Base Fuel and 2 wt % Ethanol | 0.0095 wt % (25 PTB) of Jeffamine ® Ed 900 | 4+ |
| 5 | FUEL COMPOSITION OF EXAMPLE 3 | | |
| | Base Fuel and 2 wt % Ethanol | 0.0095 wt % (25 PTB) of Jeffamine ® Ed 2001 | 4+ |

(1)0 good
+4 bad and an unacceptable value for commercial purposes.

As shown by the data in Table I, the diamino poly(oxyalkylene) additive of Example 1 was effective in stabilizing the fuel against sediment formation. Comparative Examples 2 and 3 which contained higher molecular weight diamino poly(oxalkylene) additives were not effective in stabilizing the fuel composition against sediment formation.

It will be understood that the scope of this invention is not limited to the specific examples herein presented but is to be determined by the appended claims and obvious modifications thereof.

We claim:

1. A middle distillate fuel composition comprising a mixture of hydrocarbons boiling in the range from about 300° F. to about 750° F. and an effective sediment inhibiting amount of a alpha omega diamino poly(oxypropylene) poly(oxyethylene) poly(oxypropylene) having the following formula:

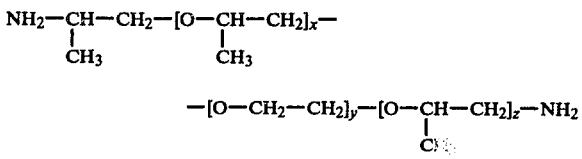

wherein x and z each has an approximate value ranging from 1 to 3 and the sum of x plus z ranges from 3 to 4 and y has an approximate value ranging from 10 to 16 and a solubilizing agent effective for solubilizing the diamino poly(oxyalkylene) in the hydrocarbon mixture comprising a $C_1$ to $C_4$ alkanol and an alkylated benzene having one or two alkyl substituents wherein the alkyl substituents has from 1 to 2 carbon atoms.

2. A composition according to claim 1 wherein y has a value from about 12 to 15.

3. A composition according to claim 1 wherein y has a value from about 13 to 14.

4. A fuel composition according to claim 1 containing from about 0.0001 to 0.1 weight percent of said sediment inhibiting diamine.

5. A fuel composition according to claim 1 wherein said sediment inhibiting diamine is present in from about 0.005 to 0.05 weight percent.

6. A fuel composition according to claim 1 wherein the sediment inhibiting diamine is present in about 0.01 weight percent.

7. A fuel composition according to claim 1, wherein the $C_1$ to $C_4$ alkanol is ethanol.

8. A fuel composition according to claim 1 wherein the alkyl substituted benzene compound is xylene.

9. A fuel composition according to claim 1 wherein the alkyl substituted benzene compound is toluene.

10. A middle distillate fuel composition comprising a mixture of hydrocarbons boiling in the range from about 300° F. to about 750° F. and 0.0095 weight percent based on the total fuel composition of a alpha omega diamino poly(oxypropylene) poly(oxyethylene) poly(oxypropylene) having the following formula:

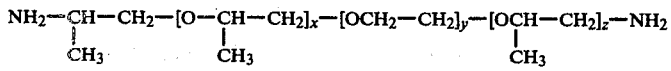

wherein x and z each has an approximate value of 1 to 3 such that the sum of x plus z is approximately 3.5 and y has an approximate value of 13.5, and a solubilizing agent effective for solubilizing the diamino poly(oxyalkylene) stabilizer in the hydrocarbon mixture comprising ethanol and xylene wherein the ethanol component is 2 weight percent of the base fuel composition and the xylene component is 2 weight percent of the base fuel composition.

* * * * *